US006551976B1

(12) United States Patent
Smith et al.

(10) Patent No.: US 6,551,976 B1
(45) Date of Patent: Apr. 22, 2003

(54) USE OF SURFACTANT MIXTURES WITH MATCHING HYDROPHOBES TO OBTAIN INCREASED PERFORMANCE IN LAUNDRY DETERGENTS

(75) Inventors: George A. Smith, Newtown, PA (US); Michael Hansberry, Plymouth Meeting, PA (US); Stephen F. Gross, Souderton, PA (US)

(73) Assignee: Cognis Corporation, Gulph Mills, PA (US)

( * ) Notice: Subject to any disclaimer, the term of this patent is extended or adjusted under 35 U.S.C. 154(b) by 0 days.

(21) Appl. No.: 08/888,468

(22) Filed: Jul. 7, 1997

(51) Int. Cl.[7] ..... C11D 1/66; C11D 1/14; C11D 1/72

(52) U.S. Cl. ..... 510/336; 510/337; 510/340; 510/351; 510/356; 510/357; 510/360; 510/470

(58) Field of Search ..... 510/336, 337, 510/340, 351, 356, 357, 360, 470

(56) References Cited

U.S. PATENT DOCUMENTS 5,266,690 A 11/1993 McCurry, Jr. et al. ..... 536/18.6
5,415,813 A * 5/1995 Misselyn et al. ..... 252/547
5,424,010 A * 6/1995 Duliba et al. ..... 252/557
5,503,779 A * 4/1996 Adamy et al. ..... 252/546
5,536,437 A * 7/1996 Motyka ..... 510/397
5,565,146 A * 10/1996 Jakubicki et al. ..... 510/235
5,610,127 A * 3/1997 Erilli et al. ..... 510/235
5,670,474 A * 9/1997 Crawford et al. ..... 510/470
5,714,451 A * 2/1998 Brouwer et al. ..... 510/324
5,728,668 A * 3/1998 Thomas et al. ..... 510/237

FOREIGN PATENT DOCUMENTS

DE 44 07 687 3/1994
DE 4407687 * 9/1995

* cited by examiner

*Primary Examiner*—Yogendra Gupta
*Assistant Examiner*—Gregory R. Delcotto
(74) *Attorney, Agent, or Firm*—John E. Drach; Steven J. Trzaska

(57) ABSTRACT

A surfactant composition containing a mixture of at least two surfactants selected from the group consisting of anionics, nonionics, cationics, amphoterics, and mixtures thereof, wherein the surfactants have matching carbon chain length distributions in their hydrophobic groups.

11 Claims, 1 Drawing Sheet

DOSE RESPONSE FOR LAE/FAES/625UP

USE OF SURFACTANT MIXTURES WITH MATCHING HYDROPHOBES TO OBTAIN INCREASED PERFORMANCE IN LAUNDRY DETERGENTS

FIELD OF THE INVENTION

The present invention generally relates to laundry detergents. More particularly, the invention relates to the use of surfactant mixtures which provide enhanced cleaning performance at lower actives levels.

BACKGROUND OF THE INVENTION

A wide variety of detersive surfactants are known in the literature and in commercial practice. Such surfactants range from common soap to sophisticated betaine and sulfobetaine synthetic surfactants. In general, the continuing search for improved detersive surfactants has been the result of the desires of the formulator to meet a growing list of cleaning needs under a wide variety of conditions. Thus, the formulator of laundry detergents must provide products which remove from fabrics a wide variety of soils and stains, ranging from petroleum oils and fatty oils to proteins, carbohydrates, clay and other particulate soils and mixtures of such soils and stains.

The most widely used surfactants in detergent compositions are nonionics, anionics, amphoterics, zwitterionics and, to some extent, cationics. It is often times desirable to employ mixtures of these types of surfactants in order to both enhance their performance and reduce the cost associated with their formulation, since certain surfactants are more costly than others.

Moreover, with the advent of increased ecotoxicological awareness, it is becoming more desirable to formulate compositions which are more environmentally friendly. This goal can be both achieved, and furthered, if it were possible to formulate detergent compositions which not only employed surfactants obtainable from renewable natural resources, but also, if detergents could be formulated using smaller amounts of ingredients (actives) without a concomitant loss in cleaning effectiveness.

SUMMARY OF THE INVENTION

The present invention is directed to the surprising discovery that by combining surfactants having matching carbon chain length distributions in their hydrophobic groups, enhanced cleaning performance can be obtained at lower surfactant concentration levels.

Thus, the present invention is directed to a surfactant composition containing a mixture of at least two surfactants selected from the group consisting of nonionics, anionics, cationics, amphoterics, and mixtures thereof, wherein the surfactants have matching hydrophobic groups.

The present invention is also directed to a process for making an improved surfactant composition involving combining at least two surfactants selected from the group consisting of nonionics, anionics, cationics, amphoterics, zwitterionics and mixtures thereof, with the proviso that the surfactants have matching hydrophobic groups.

The present invention is also directed to a cleaning formulation containing from about 5 to about 50% by weight, based on the weight of the formulation, of the above-disclosed surfactant mixture.

DESCRIPTION OF THE INVENTION

Figure 1:
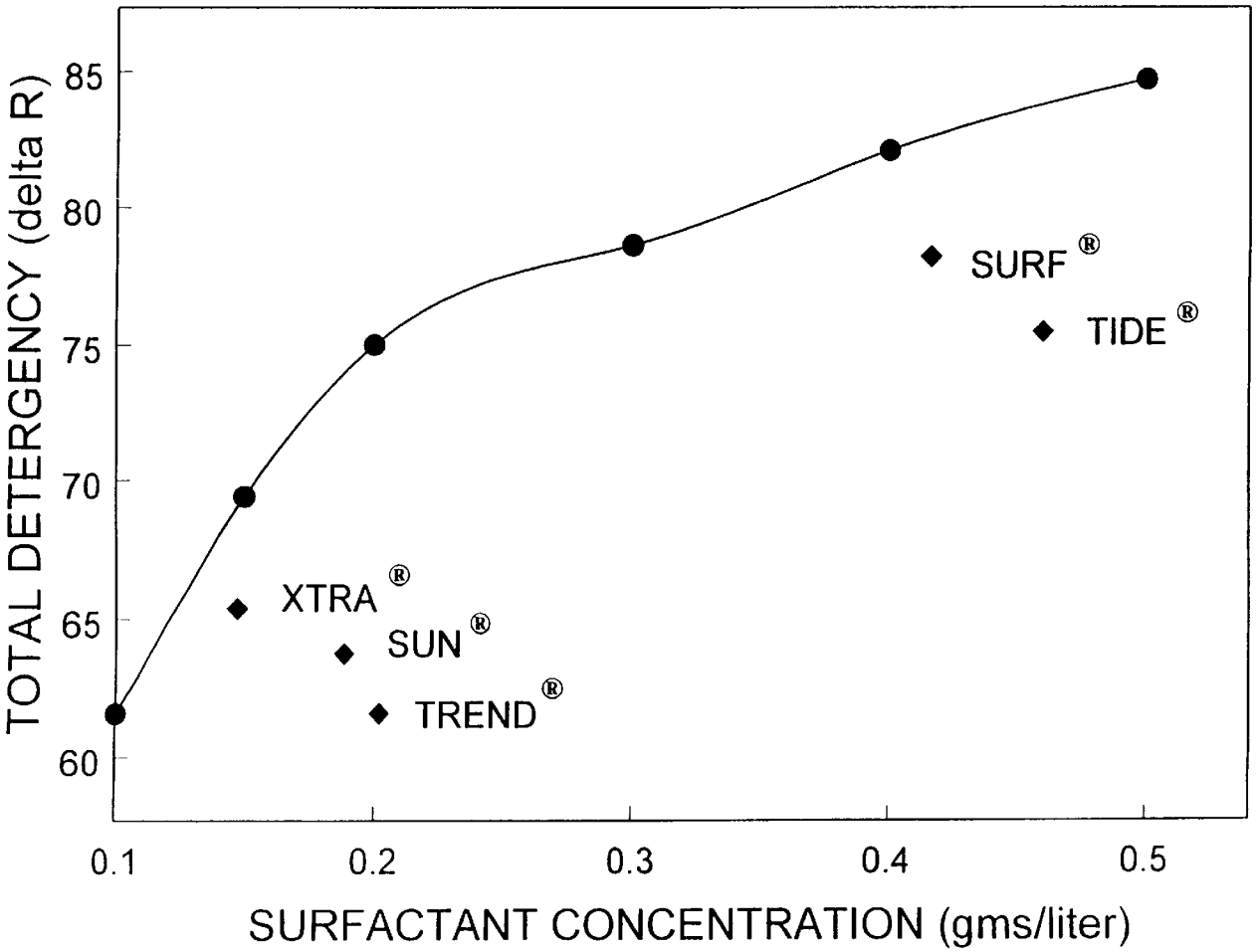
FIG. 1 is a line graph illustrating a comparison between the cleaning effectiveness of a composition in accordance with the present invention versus other known detergent compositions, at varying concentration levels.

Other than in the operating examples, or where otherwise indicated, all number expressing quantities of ingredients or reaction conditions are understood as being modified in all instances by the term "about".

The present invention is directed to the surprising discovery that by combining surfactants having matching hydrophobic groups, a surfactant mixture can be formulated having enhanced cleaning properties at concentration levels which are lower than are normally required for obtaining cleaning effectiveness.

The surfactants which may be employed are generally selected from the group consisting of anionics, nonionics, cationics and amphoterics.

Anionic surfactants are generally characterized by carrying a negative charge when dissolved in an aqueous medium. In general, carboxylates, sulfonates, sulfates and phosphates constitute the polar, solubilizing groups found in most anionic surfactants. Particularly preferred anionic surfactants are alkyl ether sulfates.

Alkyl ether sulfates are generally defined as salts of sulfated adducts of ethylene oxide with fatty alcohols containing from about 8 to about 18 carbon atoms. The alkyl ether sulfates which may be employed in the present invention are commercially available and generally contain a linear aliphatic group having from about 8 to about 18 carbon atoms, depending on the hydrocarbon starting material used to form the surfactants. The degree of ethoxylation is from 1 to about 10 moles of ethylene oxide, and preferably about 3 moles of ethylene oxide. A particularly preferred alkyl ether sulfate is based on a $C_{12/14/16}$ coconut fatty alcohol midcut.

Nonionic surfactants are generally characterized by carrying no discrete charge when dissolved in an aqueous medium. Representative groups of nonionic surfactants include, but are not limited to, linear alcohol ethoxylates, carboxylic acid esters, carboxylic amides, polyalkylene oxide block copolymers, and alkyl glycosides. Particularly preferred nonionic surfactants include linear fatty alcohol ethoxylates and alkyl polyglycosides.

Linear fatty alcohol ethoxylates are derived from $C_8$–$C_{20}$ fatty alcohols ethoxylated with from 1 to about 10 moles of ethylene oxide. A particularly preferred fatty alcohol ethoxylate is a $C_{12/14/16}$ coconut fatty alcohol midcut containing 3 moles of ethylene oxide.

The alkyl polyglycosides which can be used in the surfactant mixture according to the present invention correspond to formula I:

$$R_1O(R_2O)_b(Z)_a \qquad \text{I}$$

wherein $R_1$ is a monovalent organic radical having from about 6 to about 30 carbon atoms, once again depending on which starting material is used; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN® surfactants from Henkel Corporation, Ambler, Pa., 19002. Examples of such surfactants include but are not limited to:

1. APG® 225 Surfactant—an alkyl polyglycoside in which the alkyl group contains 8 to 10 carbon atoms and having an average degree of polymerization of 1.7.
2. APG® 425 Surfactant—an alkyl polyglycoside in which the alkyl group contains 8 to 16 carbon atoms and having an average degree of polymerization of 1.6.
3. APG® 625 Surfactant—an alkyl polyglycoside in which the alkyl group contains 12 to 16 carbon atoms and having an average degree of polymerization of 1.6.
4. APG® 325 Surfactant—an alkyl polyglycoside in which the alkyl group contains 9 to 11 carbon atoms and having an average degree of polymerization of 1.6.
5. GLUCOPON® 600 Surfactant—an alkyl polyglycoside in which the alkyl group contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl group contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated.

The preferred alkyl polyglycosides are those of formula I wherein $R_1$ is based on a coconut fatty alcohol midcut corresponding to a monovalent organic radical having ta $C_{12/14/16}$ carbon chain length distribution; b is zero; Z is a glucose residue having 5 or 6 carbon atoms; and a is a number having a value of from 1 to about 2, and most preferably about 1.6.

Cationic surfactants are characterized by the solubilizing group thereof carrying a positive charge when dissolved in an aqueous medium. The positive typically resides on an amino or quaternary nitrogen. Representative groups of cationic surfactants include, but are not limited to, amines, imidazolines and quaternary ammonium salts.

Finally, amphoteric surfactants are generally characterized by having both an acidic and basic hydrophilic group. These ionic functions may be any of the anionic or cationic groups described above. In addition, ether or a hydroxyl group may also be present in order to enhance the hydrophilicity of the surfactant molecules. A representative group of amphoteric surfactants are imidazolinium derivatives which may be prepared from 2-alkyl-1-(2-hydroxyethyl)-2-imidazolines and sodium chloroacetate.

Regardless of the particular surfactants chosen to form the surfactant mixture, i.e., mixtures of individual surfactants from a single type of surfactant such as nonionics and/or individual surfactants from various types of surfactants such as anionics and nonionics, the crux of the present invention involves the use of surfactants having matching carbon chain length distributions in their hydrophobic group.

According to one embodiment of the present invention, there is provided a surfactant mixture containing: (a) from about 30 to about 70% by weight, and preferably from about 40 to about 60% by weight, of a linear fatty alcohol ethoxylate having from about 3 to about 7 moles of ethylene oxide; (b) from about 10 to about 40% by weight, and preferably from about 20 to about 30% by weight, of an ether sulfate; and (c) from about 10 to about 40% by weight, and preferably from about 20 to about 30% by weight, of an alkyl polyglycoside, all of the weights being based on the total weight of the surfactant mixture, and wherein all of the above-identified surfactants are derived from a $C_{12/14/16}$ coconut fatty alcohol midcut, resulting in their having the same $C_{12/14/16}$ carbon chain length distribution in their hydrophobic groups.

The only way in which to insure that the carbon chain length distributions of various surfactants match is by deriving their hydrophobic groups from the same hydrocarbon starting material. For example, a coconut fatty alcohol midcut, i.e., $C_{12/14/16}$ hydrocarbon starting material can be used to form both a nonionic linear alcohol ethoxylate and an anionic ether sulfate. Because these surfactants are formed from the same hydrocarbon starting material, their hydrophobic groups will have the same carbon chain length distribution, i.e., a $C_{12/14/16}$ hydrocarbon chain.

Examples of suitable hydrocarbon starting materials include, but are not limited to, $C_4$ to $C_{22}$ fatty acids, $C_8$ to $C_{20}$ fatty alcohols, $C_8$ to $C_{20}$ oxoalcohols, nonylphenols, octylphenols, linear alkyl benzenes, secondary alkyl benzenes, and naphthalene formaldehyde condensates. Regardless of which hydrocarbon starting material is employed, all surfactants used to form the surfactant mixture of the present invention must be derived from that same starting material in order to have matching hydrophobic groups.

According to another embodiment of the present invention, there is provided a process for making a surfactant mixture involving combining at least two surfactants selected from the group consisting of anionics, nonionics, cationics and amphoterics, to form a surfactant mixture, with the proviso that the surfactants that are combined have matching carbon chain length distributions in their hydrophobic groups.

In a preferred embodiment, the surfactant mixture is formed by combining: (a) from about 30 to about 70% by weight, and preferably from about 40 to about 60% by weight, of a linear fatty alcohol ethoxylate having from about 3 to about 7 moles of ethylene oxide; (b) from about 10 to about 40% by weight, and preferably from about 20 to about 30% by weight, of an ether sulfate; and (c) from about 10 to about 40% by weight, and preferably from about 20 to about 30% by weight, of an alkyl polyglycoside, all of the weights being based on the total weight of the surfactant mixture, and wherein all of the above-identified surfactants are derived from a $C_{12/14/16}$ coconut fatty alcohol midcut, resulting in their having the same $C_{12/14/16}$ carbon chain length distribution in their hydrophobic groups.

According to another embodiment of the present invention, there is provided a cleaning composition, such as a laundry detergent, which contains from about 5 to about 50% by weight, based on the weight of the cleaning composition, of the above-disclosed surfactant mixture. In general, cleaning compositions which are formulated using the surfactant mixture of the present invention will require lower amounts of surfactant actives to be used, as compared to conventional cleaning compositions, while at the same time providing enhanced cleaning performance. It should be noted that auxiliaries such as builders, bleaching agents, foam modifiers, dyes, perfumes, viscosity regulators, and the like, may also be present in the cleaning composition without departing from the spirit of the invention.

The present invention will be better understood from the examples which follow, all of which are intended for illustrative purposes only, and are not meant to unduly limit the scope of the invention in any way.

EXAMPLES

The formulation given in Table 1 was prepared using surfactants containing matching hydrophobes based on coconut mid-cut fatty alcohol. The formulation was tested as a function of concentration using a Terge-o-tometer purchased from US Testing Company, Inc. Also included in the study were five commercial laundry detergents with known surfactant actives.

TABLE 1

Experimental Detergent Formulation using Matching Hydrophobes

| | |
|---|---|
| GENAPOL ® 26-L-60 | 4.0 |
| TEXAPON ® NC70-LS (70%) | 2.86 |
| GLUCOPON ® 625UP (50%) | 4.0 |
| VERSENE ® 100 (40%) | 0.2 |
| Monoethanolamine | 1.0 |
| NaCl | 4.0 |
| SURCIDE ® P | 0.05 |
| BLANKOPHOR ® BBH | 0.1 |
| D-Limonene | 0.5 |
| Water | QS 100 |

GENAPOL ® 26-L-60 = LAE supplied by Hoechst Celanese.
TEXAPON ® NC70-LS = 70% FAES supplied by Henkel Corp.
GLUCOPON ® 625UP = 50% alkyl polyglycoside supplied by Henkel Corp.
VERSENE ® 100 = 40% NaEDTA supplied by Dow Chemical.
SURCIDE ® P = preservative supplied by Surety Labs, Inc.
BLANKOPHOR ® BBH = optical brightener supplied by Burlington Chemical.

The experimental formulation was tested on a number of different soil types commonly encountered in home laundry. Soil types tested include dust sebum on cotton and poly/cotton, clay on cotton and poly/cotton and olive oil on cotton and poly/cotton (EMPA 101 and 104). Each soil type was run in duplicate and the results averaged to obtain the reported results. Percent soil removal was calculated using the difference in optical reflectance before and after washing. All tests were performed at 100° F. for 10 minutes, 150 ppm hard water.

FIG. 1 shows the total detergency of each sample versus the surfactant actives in the wash water. Total detergency is the sum of percent soil removal for each soil and fabric type. The solid line corresponds to the performance of the experimental formulation as a function of surfactant actives in the wash water. The points correspond to the performance of the commercial product at the recommended dosage.

The experimental formulation gives better performance at equal actives than any of the commercial formulations. Alternatively, the experimental formulation gives equivalent performance to the commercial products at lower surfactant actives. This allows detergent manufacturers to develop formulations with improved cost/performance.

What is claimed is:

1. A surfactant composition comprising:

(a) from about 40 to about 60% by weight of a linear alcohol ethoxylate having from about 3 to about 7 moles of ethylene oxide;

(b) from about 20 to about 30% by weight of an ether sulfate; and (c) from about 20 to about 30% by weight of an alkyl polyglycoside, all weights being based on the weight of the composition, wherein (a)–(c) all have a $C_{12/14/16}$ hydrophobic group.

2. A process for making a surfactant composition comprising mixing:

(a) from about 40 to about 60% by weight of a linear alcohol ethoxylate having from about 3 to about 7 moles of ethylene oxide;

(b) from about 20 to about 30% by weight of an ether sulfate; and (c) from about 20 to about 30% by weight of an alkyl polyglycoside, all weights being based on the weight of the composition, wherein (a)–(c) all have a $C_{12/14/16}$ hydrophobic group.

3. A cleaning formulation comprising from about 5 to about 50% by weight, based on the weight of the formulation, of a surfactant composition, the surfactant composition containing:

(a) from about 40 to about 60% by weight of a linear alcohol ethoxylate having from about 3 to about 7 moles of ethylene oxide;

(b) from about 20 to about 30% by weight of an ether sulfate; and (c) from about 20 to about 30% by weight of an alkyl polyglycoside, all weights being based on the weight of the composition, wherein (a)–(c) all have a $C_{12/14/16}$ hydrophobic group.

4. A surfactant composition comprising a mixture of at least two surfactants selected from the group consisting of an anionic surfactant, a nonionic surfactant, a cationic surfactant, an amphoteric surfactant and mixtures thereof, wherein the at least two surfactants have matching $C_{12/14\ 16}$ carbon chain length distributions in their hydrophobic groups, and wherein the at least two surfactants are derived from a common hydrocarbon starting material.

5. The composition of claim 4 wherein the hydrocarbon starting material is selected from the group consisting of a fatty acid, a fatty alcohol, an oxoalcohol, a linear alkyl benzene, a secondary alkyl benzene, a nonylphenol, an octylphenol, a naphthalene formaldehyde condensate, and mixtures thereof.

6. The composition of claim 4 wherein the hydrocarbon starting material is a coconut fatty alcohol midcut having a $C_{12/14/16}$ carbon chain length distribution.

7. The composition of claim 4 wherein the at least two surfactants are a linear alcohol ethoxylate having from about 1 to about 10 moles of ethylene oxide, an ether sulfate, and an alkyl polyglycoside.

8. A process for synergistically enhancing the cleaning effectiveness of a surfactant mixture comprising combining at least two surfactants selected from the group consisting of an anionic surfactant, a nonionic surfactant, a cationic surfactant, an amphoteric surfactant and mixtures thereof, wherein the at least two surfactants have matching $C_{12/14/16}$ carbon chain length distributions in their hydrophobic groups, and wherein the at least two surfactants are derived from a common hydrocarbon starting material.

9. The process of claim 8 wherein the hydrocarbon starting material is selected from the group consisting of a fatty acid, a fatty alcohol, an oxoalcohol, a linear alkyl benzene, a secondary alkyl benzene, a nonylphenol, an octylphenol, a naphthalene formaldehyde condensate, and mixtures thereof.

10. The process of claim 8 wherein the hydrocarbon starting material is a coconut fatty alcohol midcut having a $C_{12/14/16}$ carbon chain length distribution.

11. The process of claim 8 wherein the at least two surfactants are a linear alcohol ethoxylate having from about 1 to about 10 moles of ethylene oxide, an ether sulfate, and an alkyl polyglycoside.

* * * * *